US011026500B2

(12) United States Patent
Kaltreider

(10) Patent No.: US 11,026,500 B2
(45) Date of Patent: Jun. 8, 2021

(54) REFLECTIVE INSULATION SYSTEM FOR HAMMOCKS

(71) Applicant: Christian Ellington Kaltreider, Asheville, NC (US)

(72) Inventor: Christian Ellington Kaltreider, Asheville, NC (US)

( * ) Notice: Subject to any disclaimer, the term of this patent is extended or adjusted under 35 U.S.C. 154(b) by 351 days.

(21) Appl. No.: 15/994,645

(22) Filed: May 31, 2018

(65) Prior Publication Data

US 2018/0352940 A1 Dec. 13, 2018

Related U.S. Application Data

(60) Provisional application No. 62/517,105, filed on Jun. 8, 2017.

(51) Int. Cl.
*A45F 3/22* (2006.01)
*A47C 21/04* (2006.01)

(52) U.S. Cl.
CPC ..... *A45F 3/22* (2013.01); *A47C 21/048* (2013.01)

(58) Field of Classification Search
CPC . A45F 3/22; A45F 3/26; A47C 21/048; A47C 17/84; A61G 7/1055; A61G 7/1051
USPC ..... 5/122, 120
See application file for complete search history.

(56) References Cited

U.S. PATENT DOCUMENTS 326,321 A * 9/1885 Nickerson ..... A45F 3/22 5/121
329,690 A * 11/1885 Thomas ..... A45F 3/22 5/123
614,621 A * 11/1898 Palmer ..... A45F 3/22 5/122
633,111 A * 9/1899 Bartlett ..... 5/89.1
646,622 A * 4/1900 Donavin et al. ..... A45F 4/06 224/156

(Continued)

FOREIGN PATENT DOCUMENTS

AU 2012207091 B2 7/2012

OTHER PUBLICATIONS

Gillrugs, What is Flectalon, Sep. 14, 2013, first page (Year: 2013).*

(Continued)

*Primary Examiner* — Nicholas F Polito
*Assistant Examiner* — Luke Hall
(74) *Attorney, Agent, or Firm* — William G. Heedy; The Van Winkle Law Firm

(57) ABSTRACT

A reversible hammock and insulation system includes a hammock bed; a second sheet member being secured to the hammock bed along the perimeter of the hammock bed; the bottom surface of the hammock bed and the upper surface of the second sheet member each comprising a low-emissivity, thermally reflective surface; the hammock bed and second sheet member collectively being selectively operable between a first configuration, wherein the second sheet member extends downwards from the hammock bed and surrounds a dead air space and transmission through the dead air space of a quantity of radiant heat energy given off by the user is delayed due to the low-emissivity, thermally reflective surfaces surrounding the dead air space, and a second configuration, wherein the second sheet member rests atop the hammock bed when the user is lying on the lower surface of the second sheet member.

16 Claims, 10 Drawing Sheets

(56) References Cited

U.S. PATENT DOCUMENTS 688,029 A * 12/1901 Palmer ..... A45F 3/22 5/121
748,288 A * 12/1903 Klein ..... A47G 9/086 224/156
759,240 A * 5/1904 Conway ..... A45F 3/22 5/122
1,071,764 A * 9/1913 Lowrimore ..... A45F 3/22 5/122
1,158,356 A * 10/1915 Wilson ..... E04H 15/18 135/97
1,401,846 A * 12/1921 Wiles ..... A45F 3/22 5/121
1,412,064 A * 4/1922 Sanford ..... A47C 17/66 5/112
1,748,501 A * 2/1930 Stevens ..... A45F 3/22 5/122
1,762,663 A * 6/1930 McLeod ..... A47C 21/048 126/205
2,321,966 A * 6/1943 Axel ..... A45F 3/22 5/122
2,375,792 A * 5/1945 Kearny ..... A45F 3/22 5/121
2,579,964 A * 12/1951 Reynolds ..... A47C 21/048 219/526
2,788,530 A * 4/1957 Ferguson ..... A61G 1/01 5/628
3,675,256 A * 7/1972 Tallarico ..... A45F 3/22 5/120
4,484,362 A * 11/1984 Asher ..... A41D 3/08 2/69
4,549,323 A * 10/1985 Brockhaus ..... A47C 21/048 428/178
4,663,516 A * 5/1987 Blum ..... A61F 7/007 219/201
4,937,903 A * 7/1990 Joly ..... A47C 21/044 5/284
5,113,537 A * 5/1992 Turk ..... A45F 3/22 135/90
5,170,521 A * 12/1992 Light ..... A45F 3/22 296/190.02
5,271,107 A * 12/1993 Gof ..... A47K 3/127 4/572.1
5,528,779 A * 6/1996 Lee ..... A47C 7/66 2/69.5
5,533,216 A * 7/1996 Thier ..... A47G 9/086 5/413 R
5,638,979 A 6/1997 Shea
5,857,231 A * 1/1999 Wade ..... A45F 3/22 150/154
5,913,772 A * 6/1999 Clark ..... E04H 15/04 5/121
5,989,285 A * 11/1999 DeVilbiss ..... A47C 21/044 607/104
6,185,845 B1 2/2001 Gordon
6,651,277 B1 11/2003 Marson
6,948,206 B1 * 9/2005 Valencia ..... A47C 27/081 5/120
8,356,370 B1 * 1/2013 Clark ..... A45F 3/22 5/120
9,486,383 B1 * 11/2016 Pichnarcik ..... A63B 21/0552
2003/0028962 A1 * 2/2003 Batchelder ..... A45F 3/22 5/120
2007/0022531 A1 * 2/2007 Lyons ..... A45F 3/22 5/122
2009/0165205 A1 * 7/2009 Hennessy ..... A45F 3/22 5/122
2009/0205131 A1 * 8/2009 Bishop ..... A47C 17/80 5/118
2009/0265851 A1 * 10/2009 Clark ..... A45F 3/22 5/122
2013/0269104 A1 * 10/2013 Roney ..... A45F 3/22 5/122
2014/0345049 A1 * 11/2014 Gash ..... A45F 3/22 5/121
2016/0213131 A1 * 7/2016 Frazer ..... A45F 3/22
2016/0338477 A1 * 11/2016 Browning ..... A47G 9/08
2017/0224092 A1 * 8/2017 Smith, Jr. ..... A45F 3/22
2018/0064234 A1 * 3/2018 Graff ..... A45F 3/52
2018/0070707 A1 * 3/2018 Ressler ..... A45F 3/22
2018/0303229 A1 * 10/2018 Lystrup ..... A45F 3/22

OTHER PUBLICATIONS

Jolanta Šadauskiene et al., "The effect of vertical airgaps to thermal transmittance of horizontal thermal insulating layer", Oct. 14, 2010, p. 309 (Year: 2010).*

* cited by examiner

REFLECTIVE INSULATION SYSTEM FOR HAMMOCKS

RELATED APPLICATION

This application claims priority to and incorporates entirely by reference U.S. Provisional Patent Application Ser. No. 62/517,105 filed on Jun. 8, 2017.

BACKGROUND OF THE INVENTION

The present invention relates to hammocks and, more particularly, an under-hammock insulation system which is light weight and provides warmth to the hammock user's back side when lying thereon.

DISCUSSION OF THE RELATED ART

Generally, the utilization of hammock sleep systems in lieu of ground tents is increasing among backpackers and campers. Hammocks offer increased comfort and protection by keeping the user suspended off the ground, allowing the user to avoid rocky, hard, uneven, muddy, or wet terrain. Further, hammock sleep systems are very attractive to backpackers and campers because they are usually lighter weight, less bulky to pack, and simpler to set up than ground tent systems.

It has been found that in mildly cool or cold weather, hammocks are uncomfortably cold on the user's back. Hammock sleepers commonly report feeling too cool on their undersides at ambient air temperatures below 70° F. This is largely due to the fact that any insulating clothing or sleeping bag material positioned between the user and the hammock bed becomes compressed under the user's weight, largely nullifying the material's insulating capacity. Further, unlike sleeping on the ground, the underside of the hammock is exposed to radiant heat loss to the ground below, and convective heat loss to the surrounding air, which is greatly increased if any wind is present. Exacerbating the issue when compared to ground-sleeping is the fact that the ambient air temperature at night is usually cooler than the temperature of the ground. Finally, ground sleepers enjoy the advantage that the ground directly under them slowly warms over the course of the night, decreasing conductive heat loss as the night progresses.

The fact that hammocks become uncomfortably cold at relatively mild ambient temperatures makes them less attractive or unsuitable for fall, winter and spring camping in many areas of the world, as well as summer camping at higher elevations and latitudes. Since many wilderness areas, national and state parks, and national forests are in higher elevation, mountainous locations, hammocks prove to be uncomfortable year-round for overnight use in many popular outdoor destinations. Also, while hammock sleep systems would be very appropriate for many hunters, cross-country skiers, or snow-shoers, the typically cooler seasons for these sports greatly reduces the appropriateness of hammocks for sleeping overnight.

Many attempts to rectify this situation have been made, with varying success. Hammock users have put closed-cell foam or inflatable sleeping pads inside the hammock between the sleeper and the hammock bed, but these tend to shift around during the night, are generally bulky and/or heavy, and provide only moderate thermal improvement. Hammock companies have created hammocks which have built-in means of holding sleeping pads in place, but this does not improve the size, weight, or thermal performance of the pads.

As a different approach, several companies have developed insulation systems which hang below the hammock bed, typically resembling the bottom half of a sleeping bag. These systems, called under quilts, generally use down or a synthetic down-type material as the fill insulation, very similar to typical sleeping bag construction. A significant advantage of under quilts is that the insulating material is not compressed by the hammock user, since the insulation is below the weight-supporting hammock bed. These systems can be very warm. However, they are generally expensive, bulky, and heavy.

Under quilts normally attach to the ends of the hammock using adjustable elastic cords. Adjustments must be made after the user has gotten in the hammock. The adjustments are made to ensure the insulation is tight enough against the bottom of the hammock to eliminate gaps which will allow cold air to flow directly under the user's back, and loose enough that the elastic cords do not constrict the sleeping space too much or compress the insulation. Adjustments must also be made to ensure that the under quilt is properly located longitudinally under the user. Still, under quilts may shift during the night as the user moves around. The elastic attachment cords restrict the sleeping space by closing in on the hammock, can make the hammock awkward to get in and out of, and make using the hammock in a sitting or crosswise position awkward. Hence, under quilts largely negate the original benefits that make hammock sleep systems so attractive, namely low weight, low bulk, and simplicity of set up and use.

An aspect which is not addressed by any of the existing insulation systems described above is the fact that a hammock user's sensation of cold is not uniform across the entire underside of the body. The areas of the body that get coldest in a hammock are the high-pressure spots and the lowest points in the system. The most notable of these areas are the buttocks, which are usually the area of highest pressure as well as being the lowest point in the hammock. This phenomenon is commonly called Cold Butt Syndrome by hammock campers, a term that has been used by hammock companies as well. Existing insulation systems do not address Cold Butt Syndrome specifically, but instead provide uniform insulation across the entire underside of the body. Hence the performance of the entire insulation system tends to hinge on the most vulnerable area of the body to cold discomfort.

In many real-world camping situations there is a need for the hammock system to be easily adaptable to either warm or cool conditions. Night temperatures are often unknown at the start of a trip, or will be marginal, so the hammock user cannot predict whether they need to bring a bulky insulation system or just a bare hammock. Many campers like to use a hammock during the day when it is warm for resting or sitting, and at night when it is cold for sleeping. It is very common for daytime conditions to call for a cool, uninsulated hammock, and night time conditions to require a warm, insulated hammock. In these situations, it is important for the hammock sleep system to be capable of easily going from being insulated to uninsulated, and vice versa. Even during the night, the ambient temperature can change enough, or a person's metabolism can slow down enough, that a night time change in insulation is needed. Quickly changing the warmth characteristics of a hammock can be awkward when using under quilts. Under quilts require unpacking, attaching cords to the hammock, getting in the hammock, adjusting the attachments, and re-adjusting as needed. It is possible for an under quilt to be permanently attached to a hammock, but then the hammock cannot be comfortably used in warmer conditions, so this configuration is not adaptable to varying conditions.

While under quilts and other existing insulation systems are useful for their intended purposes, there exists a need in the art for an under-hammock insulation system which is easily adaptable to varying temperatures and conditions, targets areas of the user's body most vulnerable to cold, is light weight, small in packed volume, and relatively inexpensive to manufacture.

SUMMARY OF THE INVENTION

In accordance with one form of the present invention, there is provided a reversible hammock and insulation system including a hammock bed having a top surface and a bottom surface, the top and bottom surfaces forming a perimeter of the hammock bed; a second sheet member having an upper surface and a lower surface, the second sheet member being secured to the hammock bed along the perimeter of the hammock bed; the bottom surface of the hammock bed and the upper surface of the second sheet member each comprising a low-emissivity, thermally reflective surface; the hammock bed and second sheet member collectively being selectively operable between a first configuration and a second configuration; the first configuration being defined as the second sheet member extending downwards from the hammock bed such that the bottom surface of the hammock bed and the upper surface of the second sheet member surround a dead air space when a user is lying on the top surface of the hammock bed, and wherein transmission through the dead air space of a quantity of radiant heat energy given off by the user is delayed due to the low-emissivity, thermally reflective surfaces surrounding the dead air space; and the second configuration being defined as the second sheet member resting atop the hammock bed when the user is lying on the lower surface of the second sheet member.

In accordance with another form of the present invention, there is provided a reversible hammock and insulation system including a hammock bed having a top surface and a bottom surface, the top and bottom surfaces forming a perimeter of the hammock bed; a second sheet member having an upper surface and a lower surface, the second sheet member being secured to the hammock bed along the perimeter of the hammock bed; the bottom surface of the hammock bed and the upper surface of the second sheet member defining an interior cavity surface; at least a portion of the interior cavity surface comprising a low-emissivity, thermally reflective surface; the hammock bed and second sheet member collectively being selectively operable between a first configuration and a second configuration; the first configuration being defined as the second sheet member extending downwards from the hammock bed such that the interior cavity surface surrounds a dead air space when a user is lying on the top surface of the hammock bed, and wherein transmission through the dead air space of a quantity of radiant heat energy given off by the user is delayed due to the low-emissivity, thermally reflective surface of the interior cavity surface adjacent the dead air space; and the second configuration being defined as the second sheet member resting atop the hammock bed when the user is lying on the lower surface of the second sheet member.

In accordance with another form of the present invention, there is provided a reversible hammock and insulation system including a hammock bed having a top surface and a bottom surface; a plurality of sheet members each having an upper surface and a lower surface, wherein each of the plurality of sheet members is secured to the bottom surface of the hammock bed forming a corresponding outer border; the bottom surface of the hammock bed and the upper surface of each of the plurality of sheet members each comprising a low-emissivity, thermally reflective surface; the hammock bed and plurality of sheet members collectively being selectively operable between a first configuration and a second configuration; the first configuration being defined as the plurality of sheet members extending downwards from the hammock bed such that the bottom surface of the hammock bed and the upper surface of a first one of the plurality of sheet members surrounds a first dead air space and the lower and upper surfaces of each of the plurality of sheet members each form a corresponding secondary dead air space, and wherein transmission through the first and secondary dead air spaces of a quantity of radiant heat energy given off by a user lying on the top surface of the hammock bed is delayed due to the low-emissivity, thermally reflective surfaces surrounding the first and secondary dead air spaces; and the second configuration being defined as the plurality of sheet members resting atop the hammock bed when the user is lying on the lower surface of the plurality of sheet members.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the hammock assembly of the present invention is shown and generally indicated as 10.

All embodiments described here apply to camping or backpacking type hammocks. These types of hammocks include two primary parts: The hammock bed, and the suspension system. Hammock beds and suspension systems generally consist of a sheet of fabric suspended by ropes or webbing from two supports sufficiently far apart. The hammock bed usually comprises a rectangular solid-weave nylon or polyester sheet of fabric, about 10 feet long along the suspension axis and about 5 feet wide. The ends of the sheet are usually gathered or cinched at the connection point to the suspension system, which is usually rope or webbing with some means of connecting to the ends of the hammock bed and to the supports.

This invention requires the use of a radiant barrier material. A radiant barrier material is any material which has a low emissivity in the infrared portion of the electromagnetic spectrum. In other words, the material is a poor emitter, and a good reflector, of the radiant heat energy given off by humans. A common example of a radiant barrier material is a "space blanket" or "emergency blanket" which is typically made of a plastic sheet which has at least one very shiny silver side. Another radiant barrier material is an aluminized (or "silvered") light weight rip-stop nylon fabric. This material is particularly well-suited to the applications described here. The aluminized side of the material is typically silver in color, and very shiny. The material may be aluminized on one side only, in which case the other side is of a normal fabric color and finish, or it can be aluminized on both sides. The shiny, aluminized side is the low-emissivity, thermally reflective side of the material. The lower the emissivity of the material is, the better its thermal performance will be for the purposes of this invention.

Figure 1:
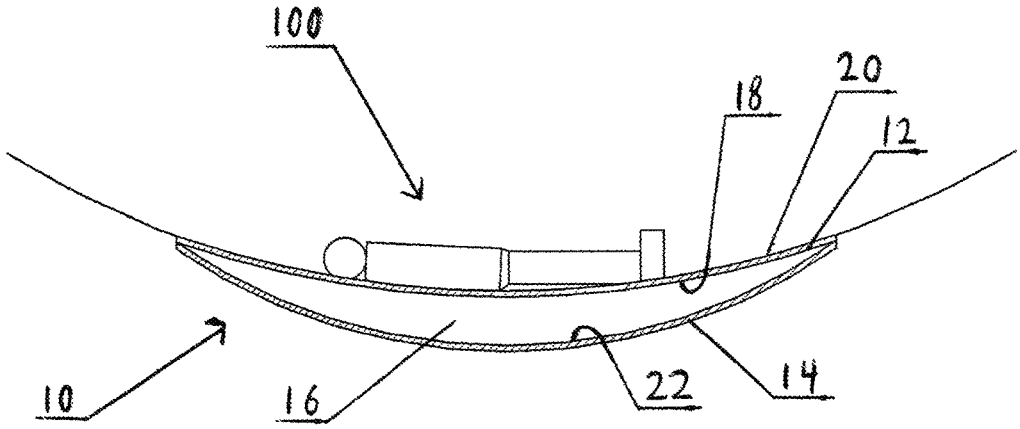
FIG. 1 is a longitudinal section view of a hammock with a sheet of thermally reflective material hanging below the hammock bed to create dead air space below the hammock bed.
Figure 2:
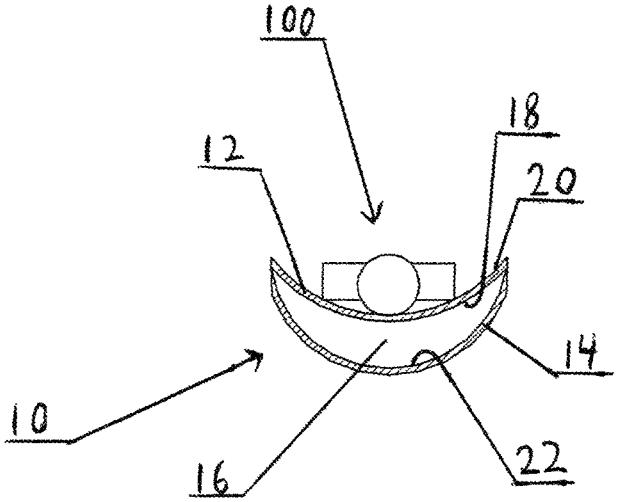
FIG. 2 is a transverse section view of the hammock system shown in FIG. 1.

Referring to FIG. 1, one embodiment of the invention is shown and includes a hammock assembly 10, which has a hammock bed 12 that supports the weight of the user, and a second sheet 14 of fabric hanging below the hammock bed 12. The second sheet 14 is cut to dimensions larger than the hammock bed 12 and is stitched, or otherwise adhered, to the perimeter of the hammock bed 12 (along both sides and both ends). In a preferred embodiment, the second sheet 14 is attached to the hammock bed 12 such that there are no gaps along the line of attachment of the second sheet 14 and the hammock bed 12. The result is that, when a person 100 lies in the hammock assembly 10, the hammock bed 12 supports the full weight of the person 100, while the second sheet 14 loosely hangs lower than the hammock bed 12. This creates a dead air space 16, or gap, between the hammock bed 12 and the second sheet 14. A typical depth for this dead air space 16 may be about 5 inches as an example, but it could be appreciably more or less, such as 1/16-12 inches, without changing the basic principle of the design. The dead air space 16 is an empty air space bounded on all sides by fabric such that infiltration and exfiltration of the surrounding atmosphere is minimized. It is important that the perimeter attachment of the second sheet 14 to the hammock bed 12 is tight enough and complete enough to minimize infiltration of outside air into the dead air space 16 (or exfiltration of air from the dead air space 16 to the outside). While a typical sewn stitch will generally suffice, other means of adhering the second sheet 14 to the perimeter of the hammock bed 12 may be used, such as, but not limited to, use of adhesives or hook and loop fasteners.

Both the hammock bed 12 and the second sheet 14 are made from one-sided thermally reflective fabric (e.g. a nylon fabric which has been aluminized on one side). The thermally reflective surface 18 of the hammock bed 12 faces downward into the dead air space 16. Thus, the hammock user lies directly on the upward facing non-reflective surface 20. The thermally reflective surface 22 of the second sheet 14 faces upward into the dead air space 16.

A key aspect of this invention, including all design variations, is that there is a dead air space directly underneath the person in the hammock, and that at least one of the two interior surfaces of the dead air space is thermally reflective. It is not necessary that both surfaces facing a dead air space be thermally reflective, but performance improves when both surfaces are thermally reflective.

Figure 3:
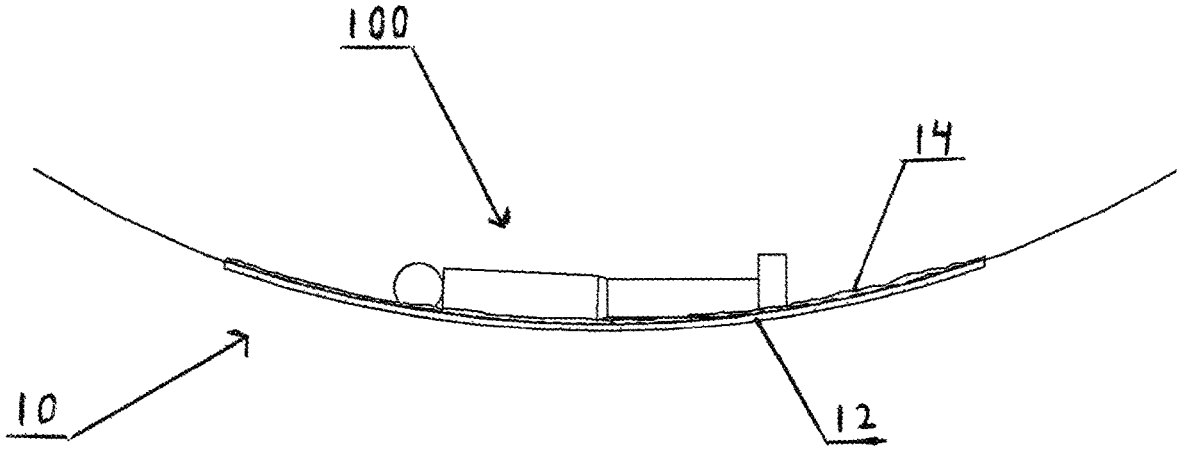
FIG. 3 is a longitudinal view of the hammock system described in FIG. 1, but with the hammock flipped over such that the loose sheet of material lies on top of the hammock bed.
Figure 4:
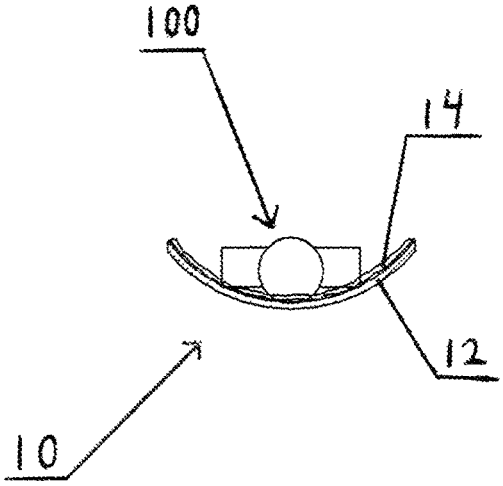
FIG. 4 is a transverse section view of the hammock system and configuration shown in FIG. 3.

The embodiment described above, as well as those that follow, will allow the hammock assembly to be easily "reversed" for use in warm weather. This is a unique quality which is made possible by the lack of any insulating fill material. This reversal can be easily achieved by flipping the hammock assembly 10 over such that the previously hanging second sheet 14 lies directly on top of the weight-supporting hammock bed 12 (see FIGS. 3 and 4). The person 100 then lies on top of the second sheet 14, with their weight supported by the hammock bed 12. Thus the second sheet 14 is between the person 100 and the hammock bed 12, and the air is expelled out of the dead air space 16. This eliminates the dead air space 16, which removes the great majority of the system's insulating performance. With the dead air space gone, the effect of the radiant barrier is nullified as the person's body heat can simply conduct directly through the two sheets of fabric to the outside air. The result is a much "cooler" hammock which can be comfortably used at higher ambient temperatures, very similar to a typical un-insulated one-layer camping hammock.

This type of reversal for warm weather use is not effective with fill-based insulation systems. When a fill-based insulation system is flipped over as described above, the fill will only compress at the higher-pressure areas (buttocks, upper back) between the person and the hammock bed. Much of the insulation surrounding the person and under the lower pressure areas (low back, between legs) does not become as thoroughly compressed. Even the compressed areas of insulation retain substantially more insulating value than if there were no fill at all. The result is neither comfortable in warm or in cool conditions because the insulation varies drastically from one area of the body to another.

Figure 5:
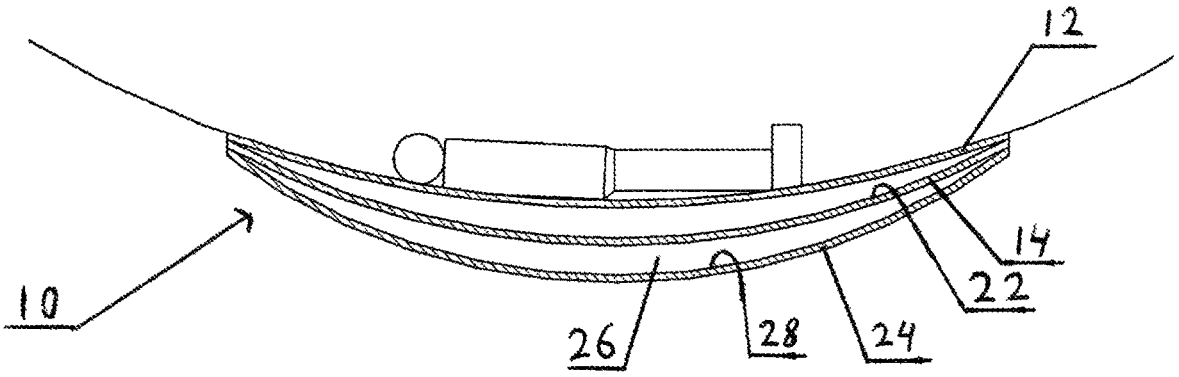
FIG. 5 is a longitudinal section view of a hammock with two sheets of thermally reflective material hanging below the hammock bed to create two dead air spaces below the hammock bed.
Figure 6:
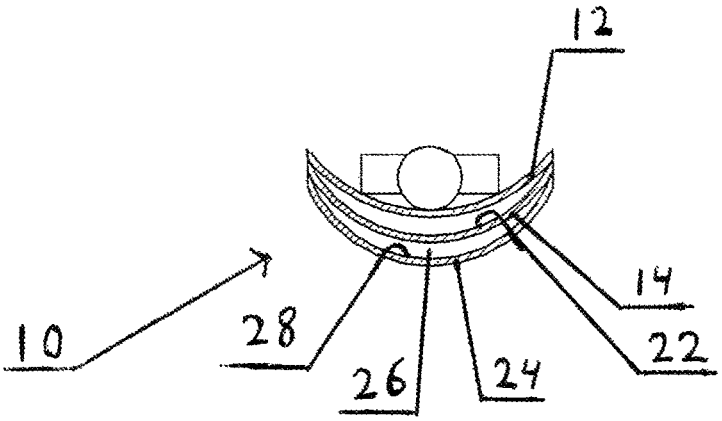
FIG. 6 is a transverse section view of the hammock system shown in FIG. 5.
Figure 15:
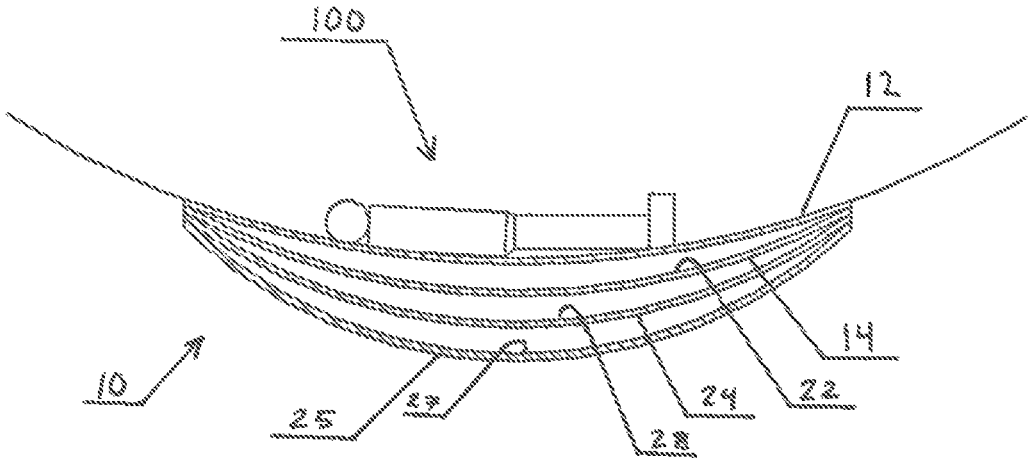
FIG. 15 is a longitudinal section view of a hammock with three sheets of thermally reflective material hanging below the hammock bed to create three dead air spaces below the hammock bed.
Figure 16:
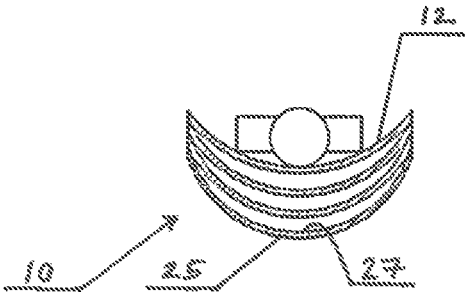
FIG. 16 is a transverse section view of the hammock system shown in FIG. 15.

Various embodiments can be conceived which will significantly increase the thermal performance and/or usability of the system. One concept is to create multiple layers of dead air space bounded by thermally reflective surfaces. This is an effective approach because, for the same total depth of radiant barrier insulation, multiple layers of dead air space can achieve much better insulating value than a single dead air space can. FIGS. 5 and 6 show an embodiment in which a third sheet 24 is stitched to the perimeter of the hammock bed 12 such that it hangs lower than, and encloses, the second sheet 14. In this embodiment, a dead airspace 26 is created between the second sheet 14 and the third sheet 24. Like the hammock bed 12 and the second sheet 14, the third sheet 24 is made from one-sided thermally reflective fabric. The thermally reflective surface 28 of the third sheet 24 faces upwards, into dead air space 26. Since both surfaces of the second sheet 14 now face dead air spaces, a beneficial embodiment variation would be to use a two-sided thermally reflective fabric for the second sheet 14. In this manner all surfaces facing a dead air space in the system would be thermally reflective. FIGS. 15 and 16 show an embodiment similar to the one illustrated in FIGS. 5 and 6 and including a fourth sheet 25 having an upward-facing thermally reflective surface 27.

Figure 7:
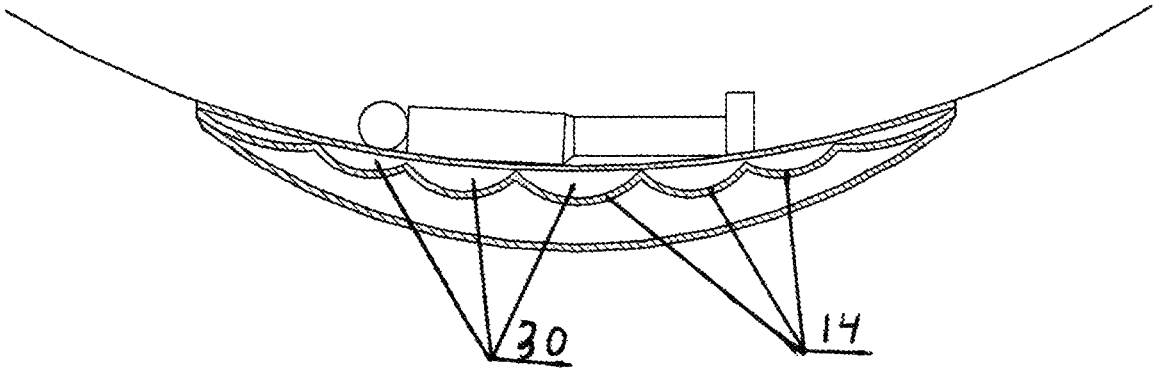
FIG. 7 is a longitudinal section view of a hammock with two sheets of thermally reflective material hanging below the hammock bed, the first being attached to the hammock bed in a quilted manner to create multiple compartmentalized dead air spaces.
Figure 8:
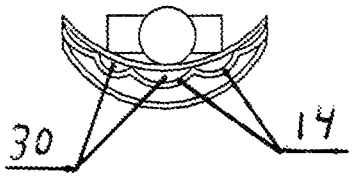
FIG. 8 is a transverse section view of the hammock system shown in FIG. 7.

The benefits of a multilayer system can be partially "short-circuited" by heat transferring from the person, through the hammock bed, into the first dead air space and then, via convection currents, upwards and back out the hammock bed in the areas outside the outline of the person's body (heat exits the dead air space by conducting across the hammock bed in an upwards direction). A concept which can mitigate this effect and greatly improve overall thermal performance is to compartmentalize the dead air spaces to reduce internal convective flow, and in particular to cut off convective flow between warm sections of the hammock bed (within the body outline) and cold sections of the hammock bed (outside the body outline). One way to accomplish this is to use a grid (or quilt) pattern of stitching when attaching a fabric sheet to the hammock bed such that multiple smaller pockets of dead air space are created in lieu of one large dead air space. FIGS. 7 and 8 show this type of embodiment, in which the second sheet 14 is stitched to the hammock bed in a quilted manner to create multiple compartmentalized dead air spaces 30.

Figure 9:
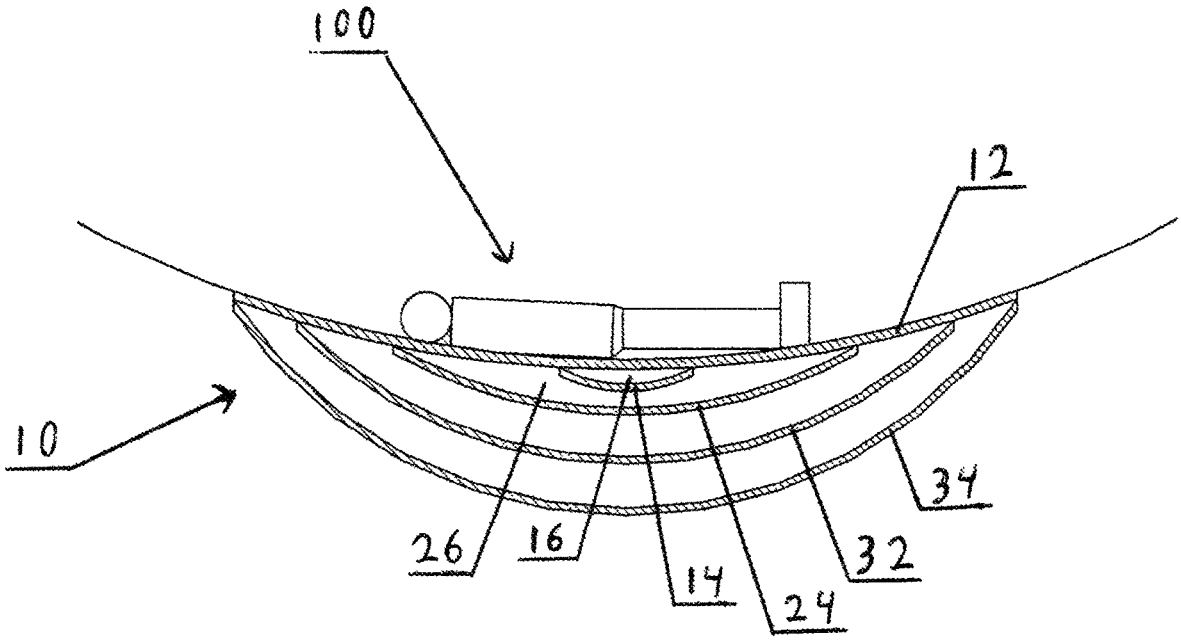
FIG. 9 is a longitudinal section view of a hammock with multiple sheets of thermally reflective material hanging below the hammock bed in a concentric manner to create multiple dead air spaces.
Figure 10:
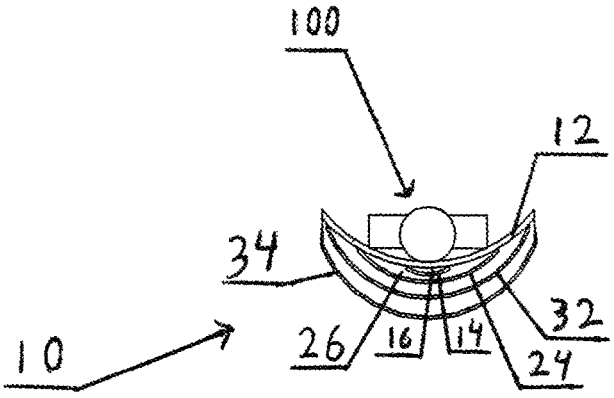
FIG. 10 is a transverse section view of the hammock system shown in FIG. 9.
Figure 17:
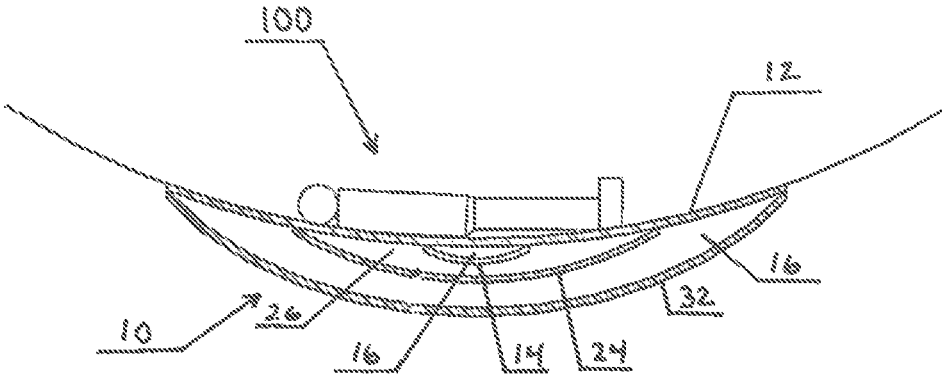
FIG. 17 is a longitudinal section view of a hammock with multiple sheets of thermally reflective material hanging below the hammock bed in a concentric manner to create multiple dead air spaces.
Figure 18:
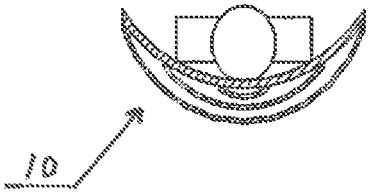
FIG. 18 is a transverse section view of the hammock system shown in FIG. 17.

As described above, heat loss in a hammock is non-uniform, and hammock users tend to first get cold in the area of the buttocks. FIGS. 9 and 10 show a method of compartmentalization which targets the buttocks and hips by using a concentric pattern of thermally reflective fabric layers. In this embodiment, the hammock bed 12 supports the weight of the person as in other embodiments. But the second sheet 14 is a much smaller piece of fabric than in the previously described embodiments, only large enough to create a dead air space 16 under the buttocks and hips of the person 100. The second sheet 14 is stitched to the hammock bed 12 somewhere in the middle of the hammock bed 12 as opposed to the perimeter of the hammock bed 12. The third sheet 24 is larger than the second sheet 14, allowing it to enclose the second sheet 14 with a dead air space 26 in between, and to cover a larger portion of the person's 100 body outline. This pattern continues with the fourth sheet 32 enclosing the third sheet 24 and the fifth sheet 34 enclosing the fourth sheet 32. The fifth sheet 34 is attached at the perimeter of the hammock bed 12 with a continuous stitch. In this concentric compartmentalized embodiment, the person in the hammock may have, for instance, four dead air spaces under the middle portion of his or her body, three dead air spaces under more peripheral portions of their body, two dead air spaces under even more peripheral portions of their body, and so on. In this manner the areas which tend to get the coldest are given the most insulation, and weight and volume are saved by not over-insulating the less vital areas of heat loss. FIGS. 17 and 18 show an embodiment similar to the one illustrated in FIGS. 9 and 10, including second sheet 14, third sheet, 24 and fourth sheet 32, but not including fifth sheet 34.

Figure 11:
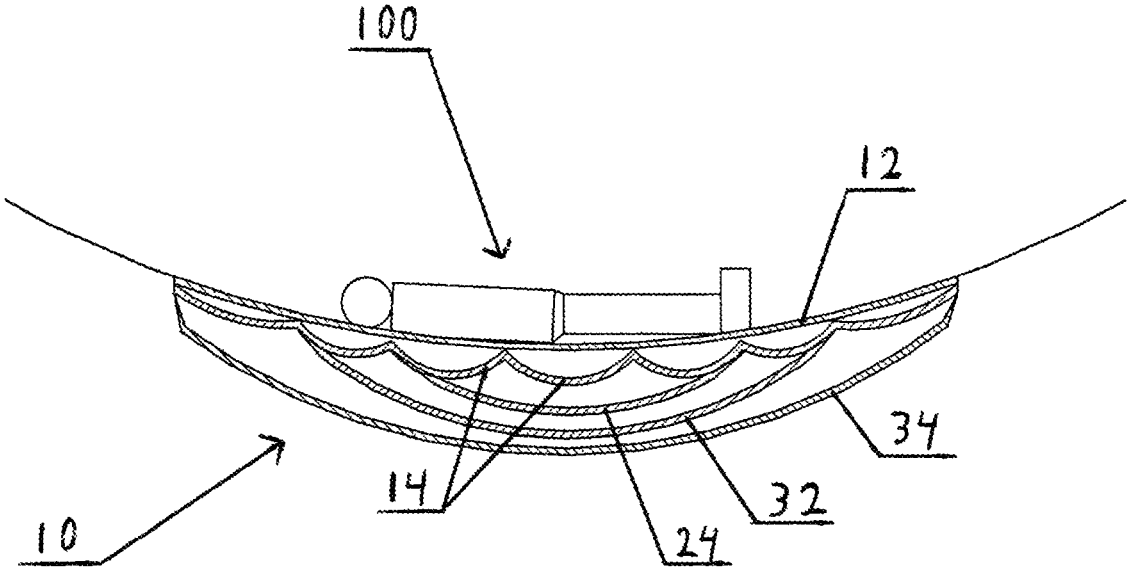
FIG. 11 is a longitudinal section view of a hammock with multiple sheets of thermally reflective material hanging below the hammock bed, the first being attached to the hammock bed in a quilted manner, and the rest attached in a concentric manner.
Figure 12:
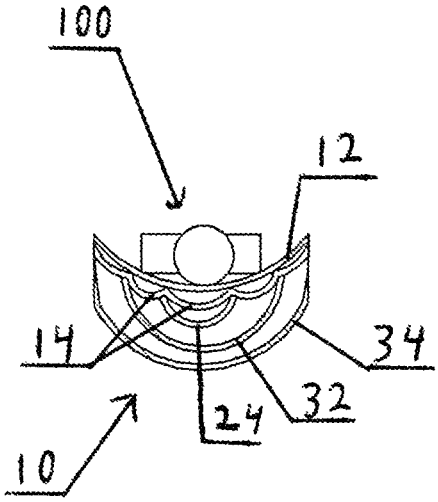
FIG. 12 is a transverse section view of the hammock system shown in FIG. 11.

The above-described methods of compartmentalization and targeted insulation placement can be combined as shown in FIGS. 11 and 12. In this embodiment, the hammock bed 12 supports the person's 100 weight as in other embodiments, the second sheet 14 is attached to the hammock bed 12 in a grid or quilt pattern, and the third, fourth, and fifth sheets 24, 32, 34 are attached in the concentric configuration.

Figure 13:
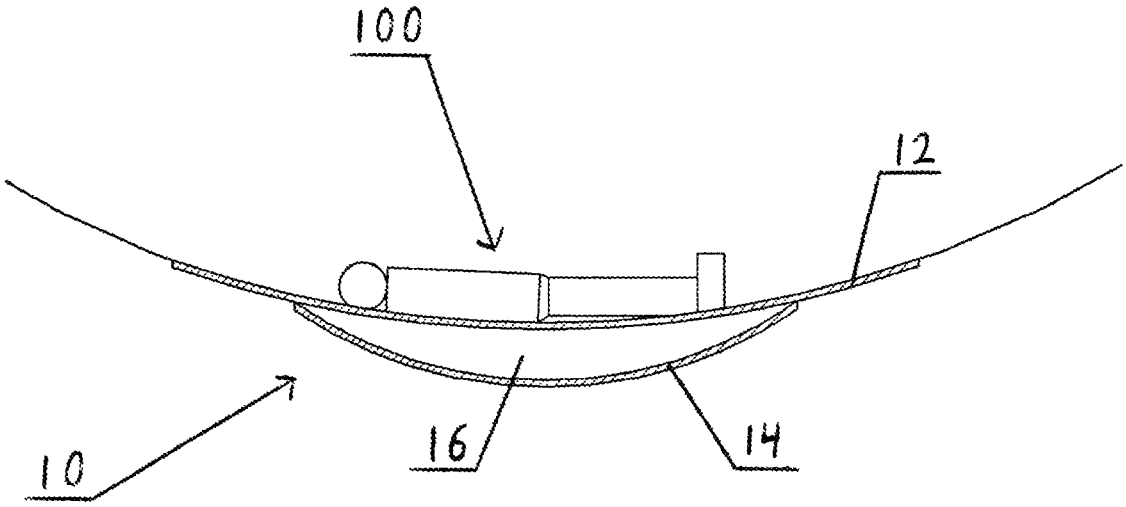
FIG. 13 is a longitudinal section view of a hammock with a sheet of thermally reflective material hanging below the hammock bed, attached to the hammock bed close to the outline of the user's body.
Figure 14:
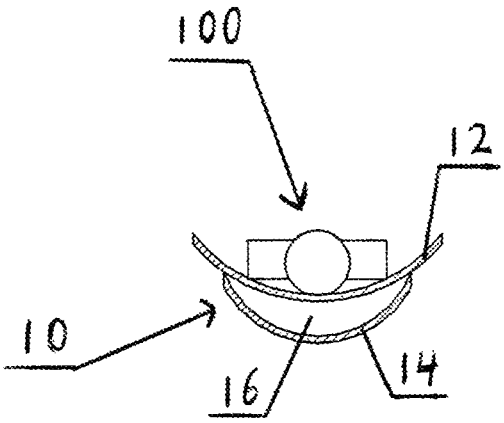
FIG. 14 is a transverse section view of the hammock system shown in FIG. 13.

None of the embodiments described above require that the outermost sheet be attached to the extreme perimeter of the hammock bed. Instead, the entire system can be designed to only provide insulation under the area where a person typically sleeps, or only under a portion of the person's body, rather than the entire hammock. FIGS. 13 and 14 show a hammock assembly 10 in which the second sheet 14 is large enough to create a dead air space 16 under the entire sleeping area of the person 100, but not the entire hammock bed 12. The second sheet 14 is stitched to the hammock bed 12 somewhere in the middle of the hammock bed 12 as opposed to the perimeter of the hammock bed 12. This approach offers both weight-saving and thermal performance benefits by reducing the amount of material used and by reducing the thermal "short-circuiting" described above.

An under-hammock application is particularly suited to a reflective insulation system for two primary reasons. First, the thermal performance of a reflective insulation system is highly dependent on the orientation of the system and the direction of heat flow. A horizontally oriented reflective insulation system performs only moderately well when the direction of heat flow across the system is upwards. However, its performance improves dramatically when the direction of heat flow is downward (as is the case with under-hammock insulation, where a warm body is above the insulation and cold air is below the insulation). This difference in performance based on orientation is an effect of the convective portion of the heat transfer through the dead air space. Under-hammock insulation systems offer a unique opportunity to take advantage of the orientation-dependent qualities of a reflective insulation system.

Secondly, the fact that the insulation system is hanging below the person means it does not have to create its own loft. Gravity will naturally create the dead air space required. No compressive structure, such as down insulation or open cell foam, is needed. Also, no significant tensile structure is needed as would be the case in an inflatable insulation system designed to hold air under pressure (e.g. inflatable camping pads). So no weight or volume is wasted on loft-creating fill material or on structural systems designed to self-inflate, encapsulate air for compressive purposes, or to maintain the air gap.

The result of a fill and loft-based insulation system is an inherent resistance to compression, hindering low-volume packing. In contrast, the reflective insulation system described here requires only empty space between fabric layers. This fact not only allows for very low-volume packing, but is also what allows this invention to be "reversed" such that its insulating qualities are virtually eliminated for warm weather applications (as described above).

Utilizing fabric which is reflective on both sides can be particularly beneficial when used in the middle layers in any multiple-layer design.

All of the design variations described above use an integrated hammock insulation approach, i.e., the insulation system is a non-detachable part of the hammock. As an alternative, these concepts and designs can be equally applied to a detachable system, where the weight-supporting hammock is a separate entity from the under-hammock insulation system. In a detachable system, the key detail is that the uppermost layer of fabric in the insulation system must be secured to the hammock such that it fits snugly against the hammock when a person is inside. It is vital that there is no airspace between the insulation system and the weight-supporting hammock fabric.

A beneficial, but not vital, attribute which the radiant barrier material may have is breathability (allows water-vapor to pass through the material). This will reduce the risk of surface condensation.

Figure 19:
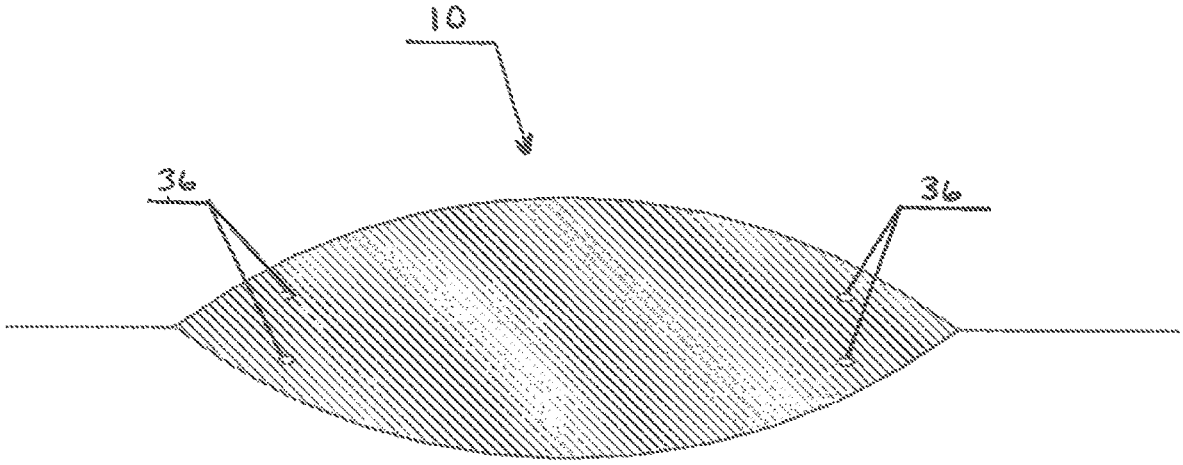
FIG. 19 is a bottom plan view of the hammock system including a plurality of slits.

When packing the hammock insulation system, it is helpful to be able to expel the air from the dead air space(s). Similarly, when setting up the hammock insulation system it is necessary to allow air to fill the dead air space(s). While the stitching method or the material itself may allow air to slowly pass into or out of the dead air space(s), it is also possible to form small slits 36 (see FIG. 19) in the fabric for each dead air space such that air can make its way in when shaken or pulled in a particular way, but which does not invite excessive infiltration/exfiltration via wind or natural convection. If the slits 36 are made longitudinally, they will naturally close and limit infiltration when the hammock is set up, due to the light tension along the length of the fabric. However, the slits 36 will open as needed when the hammock is shaken to allow air in, or when pressure is applied to expel air out.

While the present invention has been shown and described in accordance with several preferred and practical embodiments, it is recognized that departures from the instant disclosure are contemplated within the spirit and scope of the present invention.

What is claimed is:

1. A reversible hammock and insulation system comprising:

a hammock bed having a top surface and a bottom surface, the top and bottom surfaces forming a perimeter of the hammock bed;

a second sheet member having an upper surface and a lower surface, the second sheet member being permanently secured to the hammock bed along the entire perimeter of the hammock bed to create a dead air space;

the perimeter being secured in a manner to substantially minimize the infiltration of the surrounding atmosphere into the dead air space and to substantially minimize the exfiltration of air from the dead air space to the surrounding atmosphere;

the bottom surface of the hammock bed and the upper surface of the second sheet member each comprising a low-emissivity, thermally reflective surface;

the hammock bed and second sheet member collectively being selectively operable between a first configuration and a second configuration;

the first configuration being defined as the second sheet member extending downwards from the hammock bed such that the bottom surface of the hammock bed and the upper surface of the second sheet member surround the dead air space when a user is lying on the top surface of the hammock bed, and wherein transmission through the dead air space of a quantity of radiant heat energy given off by the user is delayed due to the low-emissivity, thermally reflective surfaces surrounding the dead air space; and the second configuration being defined as the second sheet member resting atop the hammock bed when the user is lying on the lower surface of the second sheet member.

2. The reversible hammock and insulation system as recited in claim 1 wherein the distance between the bottom surface of the hammock bed and the second sheet member surrounding the dead air space is between 1 inch and 12 inches.

3. The reversible hammock and insulation system as recited in claim 1 wherein at least one elongate slit is formed on the second sheet member, the slit defining an airflow passage, and the at least one elongate slit being oriented on the second sheet member such that the at least one elongate slit is predominantly parallel to the top surface of the hammock bed and is closed when the hammock bed and second sheet member are collectively in the first configuration.

4. The reversible hammock and insulation system as recited in claim 1 wherein the second sheet member is permanently attached to the hammock bed at multiple, adjacent intervals in a quilted manner for creating a plurality of dead air spaces between the second sheet member and the bottom surface of the hammock bed.

5. The reversible hammock and insulation system as recited in claim 1 wherein the distance between the bottom surface of the hammock bed and the second sheet member surrounding the dead air space is about 5 inches.

6. A reversible hammock and insulation system comprising:

a hammock bed having a top surface and a bottom surface, the top and bottom surfaces forming a perimeter of the hammock bed;

a second sheet member having an upper surface and a lower surface, the second sheet member being permanently secured to the hammock bed along the entire perimeter of the hammock bed to create a dead air space;

the perimeter being secured in a manner to substantially minimize the infiltration of the surrounding atmosphere into the dead air space and to substantially minimize the exfiltration of air from the dead air space to the surrounding atmosphere;

the bottom surface of the hammock bed and the upper surface of the second sheet member defining an interior cavity surface;

at least a portion of the interior cavity surface comprising a low-emissivity, thermally reflective surface;

the hammock bed and second sheet member collectively being selectively operable between a first configuration and a second configuration;

the first configuration being defined as the second sheet member extending downwards from the hammock bed such that the interior cavity surface surrounds the dead air space when a user is lying on the top surface of the hammock bed, and wherein transmission through the dead air space of a quantity of radiant heat energy given off by the user is delayed due to the low-emissivity, thermally reflective surface of the interior cavity surface adjacent the dead air space; and the second configuration being defined as the second sheet member resting atop the hammock bed when the user is lying on the lower surface of the second sheet member.

7. The reversible hammock and insulation system as recited in claim 6 wherein the distance between the bottom surface of the hammock bed and the second sheet member surrounding the dead air space is between 1 inch and 12 inches.

8. The reversible hammock and insulation system recited in claim 6 wherein the bottom surface of the hammock bed comprises the low-emissivity, thermally reflective surface.

9. The reversible hammock and insulation system recited in claim 6 wherein the upper surface of the second sheet member comprises the low-emissivity, thermally reflective surface.

10. The reversible hammock and insulation system as recited in claim 6 wherein at least one elongate slit is formed on the second sheet member, the slit defining an airflow passage, and the at least one elongate slit being oriented on the second sheet member such that the at least one elongate slit is predominantly parallel to the top surface of the hammock bed and is closed when the hammock bed and second sheet member are collectively in the first configuration.

11. The reversible hammock and insulation system as recited in claim 6 wherein the second sheet member is permanently attached to the hammock bed at multiple, adjacent intervals in a quilted manner for creating a plurality of dead air spaces between the second sheet member and the bottom surface of the hammock bed.

12. The reversible hammock and insulation system as recited in claim 6 wherein the distance between the bottom surface of the hammock bed and the second sheet member surrounding the dead air space is about 5 inches.

13. A reversible hammock and insulation system comprising:

a hammock bed having a top surface and a bottom surface;

a plurality of sheet members each having an upper surface and a lower surface, wherein each of the plurality of sheet members is permanently secured to the bottom surface of the hammock bed forming a corresponding outer border;

wherein the plurality of sheet members comprises:

a second sheet member having a first corresponding outer border;

the second sheet member being permanently attached to the hammock bed at multiple, adjacent intervals in a quilted manner for creating a plurality of first dead air spaces between the second sheet member and the bottom surface of the hammock bed; and a third sheet member having a second corresponding outer border that is permanently attached to the second sheet member;

the bottom surface of the hammock bed and the upper surface of each of the plurality of sheet members each comprising a low-emissivity, thermally reflective surface;

the hammock bed and plurality of sheet members collectively being selectively operable between a first configuration and a second configuration;

the first configuration being defined as the plurality of sheet members extending downwards from the hammock bed such that the bottom surface of the hammock bed and the upper surface of a first one of the plurality of sheet members surrounds a first dead air space and the lower and upper surfaces of each of the plurality of sheet members each form a corresponding secondary dead air space, and wherein transmission through the first and secondary dead air spaces of a quantity of radiant heat energy given off by a user lying on the top surface of the hammock bed is delayed due to the low-emissivity, thermally reflective surfaces surrounding the first and secondary dead air spaces;

each of the outer borders being secured in a manner to substantially minimize the infiltration of the surrounding atmosphere into the first and secondary dead air spaces and to substantially minimize the exfiltration of air from the first and secondary dead air spaces to the surrounding atmosphere; and the second configuration being defined as the plurality of sheet members resting atop the hammock bed when the user is lying on the lower surface of the plurality of sheet members.

14. The reversible hammock and insulation system as recited in claim 13 wherein the distance between the bottom surface of the hammock bed and each of the plurality of sheet members surrounding the corresponding first and secondary dead air spaces is between 1 inch and 12 inches.

15. The reversible hammock and insulation system as recited in claim 13 wherein at least one elongate slit is formed on at least one of the plurality of sheet members, the slit defining an airflow passage, and the at least one elongate slit being oriented on the at least one of the plurality of sheet members such that the at least one elongate slit is predominantly parallel to the top surface of the hammock bed and is closed when the hammock bed and the plurality of sheet members are collectively in the first configuration.

16. The reversible hammock and insulation system as recited in claim 13 wherein the distance between the bottom surface of the hammock bed and a bottom-most one of the plurality of sheet members surrounding the corresponding first and secondary dead air spaces is about 5 inches.

* * * * *